US005363736A

United States Patent [19]

Huang

[11] Patent Number: 5,363,736

[45] Date of Patent: Nov. 15, 1994

[54] SEMI-AUTOMATIC ANCHOR SHOOTER

[76] Inventor: Kuang-Wu Huang, No. 66, Min-Chyuan W. Rd., Taipei, Taiwan, Prov. of China

[21] Appl. No.: 177,390

[22] Filed: Jan. 5, 1994

[51] Int. Cl.[5] ..... B25C 1/08

[52] U.S. Cl. ..... 89/1.14; 227/10; 227/11

[58] Field of Search ..... 89/1.14; 277/9, 10, 277/11

[56] References Cited

U.S. PATENT DOCUMENTS

| | | | |
|---|---|---|---|
| 3,016,539 | 1/1962 | Marsh et al. | 227/10 |
| 3,029,434 | 4/1962 | Henning et al. | 227/9 |
| 3,060,437 | 10/1962 | Henning et al. | 227/9 |
| 3,171,131 | 3/1965 | De Caro et al. | 227/10 |
| 3,297,224 | 1/1967 | Osborne | 227/10 |
| 3,554,425 | 1/1971 | Oesterle | 227/10 |
| 3,690,536 | 9/1972 | Bakoledis | 227/10 |
| 3,743,159 | 7/1973 | Schneider | 227/10 |
| 4,655,380 | 4/1987 | Haytayan | 227/10 |
| 4,848,209 | 7/1989 | Almeras | 89/1.14 |
| 5,135,150 | 8/1992 | Chun | 227/9 |

*Primary Examiner*—David Brown
*Attorney, Agent, or Firm*—Bacon & Thomas

[57] ABSTRACT

The present invention relates to a semi-automatic anchor shooter, more particularly to a powder-actuated anchor shooter which may shoot anchors at high precision and has a muffler chamber to minimize the noise from the explosion of powder. The disclosed anchor shooter consists of a shooting mechanism and a thrusting mechanism. The shooting mechanism provides convenient and precise aiming, and the thrusting mechanism provides buffer shooting, these together with a shell-free powder chain and a powder feeding mechanism enable the anchor shooter to steadily, efficiently, and powerfully shoot and implant anchors into a structural material at high precision.

3 Claims, 8 Drawing Sheets

SEMI-AUTOMATIC ANCHOR SHOOTER

BACKGROUND OF THE INVENTION

A conventional powder-actuated fastening tool for thrusting anchors into hard cement wall or rock wall by means of explosive force produced by powders is shown in FIGS. 7 and 8, which is a substantially tubular tool and mainly includes a chamber tube 1*a*, a discharge tube 2*a*, a shell remover 3*a*, a sleeve 4*a*, a coupling 5*a*, an inner sliding block 6*a*, and a handle 7*a*. The chamber tube 1*a* is received in the discharge tube 2*a*, the discharge tube 2*a* has a front cover 21*a* and a rear cover 22*a* to substantially close two ends thereof, the shell remover 3*a* extends at one end into the chamber tube 1*a* and bears at a rear portion thereof an inner spring 31*a*, a limit nut 32*a* is screwed to a rear end of the shell remover 3*a* to prevent the inner spring 31*a* from moving out of the shell remover 3*a* and thereby limits the displacement range of the shell remover 3*a*. The chamber tube 1*a* has a threaded rear end which extends out the rear cover 22*a* of the discharge tube 2*a* to engage with the coupling 5*a* so that the rear end of the shell remover 3*a* along with the inner spring 31*a* extends into the coupling 5*a*. An outer spring 33*a* is put over the inner spring 31*a* to enable the sleeve 4*a* to springily slide over the coupling 5*a*. A positioning slot 51*a* is provided at each side of the coupling 5*a*, and, pin holes 41*a* are provided on the sleeve 4*a* corresponding to the positioning slots 51*a*. A pin 42*a* is inserted into the pin hole 41*a* at one side of the sleeve 4*a* and extends through the internal sliding block 6*a* to fix the same in the hollow coupling 5*a*. When the sleeve 4*a* slides forward over the coupling 5*a*, it brings the sliding block 6*a* to move together so that the sliding block 6*a* may push the limit nut 32*a* screwed to the rear end of the shell remover 3*a*, causing the same to remove the shell in a longitudinal direction.

To operate such a conventional powder-actuated fastening tool, first insert a shaped powder 8*a* into a stepped hole at a front of the chamber tube 1*a*, then, position an anchor 9*a* having a ring 91*a* in a front inner hole of the chamber tube 1*a*, allowing a distance left between the hammering end of the anchor 9*a* and the shaped powder 8*a*. The ring 91*a* of the anchor 9*a* is fixedly attached to the anchor 9*a* and is used to seal the front opening of the chamber tube 1*a* so that the interior of chamber tube 1*a* forms a closed explosion chamber and to maintain the distance left between the anchor 9*a* and the powder 8*a*. When an anchor 9*a* is to be forced into a wall or other structural material, such as the light-weight steel frame below the ceiling, screw the handle 7*a* to the rear end of the above-described fastening tool, aim the anchor 9*a* at the desired spot, and make strenuous efforts to push the handle 7*a*, causing the anchor 9*a* to disengage from the ring 91*a* and shifts backward. When the hammering end of the anchor 9*a* contact the percussion cap of the powder 8*a*, the powder 8*a* explodes, and the explosive pressure so produced in the closed chamber of the chamber tube 1*a* pushes the anchor 9*a* in a reverse direction toward the wall or the target with a extremely big hammering force. When the anchor 9*a* is hammered into the wall or the target, the ring 91*a* shall be forced to a rear position near the hammering end of the anchor 9*a*.

There are several disadvantages existed in the conventional powder-actuated fastening tool and needing improvement:

1. The anchor 9*a* projects out of the front end of the chamber tube 1*a*. For the anchor 9*a* to disengage from the ring 91*a* and move back an adequate distance within an instantaneous moment, the user must keep the anchor 9*a* at an adequate launching distance from the wall or target and aim the anchor 9*a* at the desired spot and push the handle 7*a* instantaneously to hammer the anchor 9*a* in place. However, since there is a launching distance left between the anchor 9*a* and the wall, and the long handle 7*a* may not be always pushed steadily to precisely aim the anchor 9*a* at the target, the anchor 9*a* is frequently forced into a place deviated from the desired point and must be extracted from the wall and another anchor 9*a* must be hammered again. All of these cause waste in time, labor and material. The design thereof is not practical nor economical.
2. The handle 7*a* must be strenuously pushed in an instantaneous moment so that the hammering end of the anchor 9*a* may contact the percussion cap of the shaped powder 8*a* to explode the powder 8*a*. The operation is laborious and inconvenient.
3. The powder 8*a* can be used to hammer only one single anchor 9*a* each time. The user has to re-load the anchor 9*a* and shaped powder 8*a* each time an anchor 9*a* is hammered. The efficiency in using the conventional powder-actuated fastening tool is therefore very low.
4. All the conventional powder-actuated fastening tools available in the market do not have muffler, and the loud noise from explosion during operation might have reverse influence on the living quality of area surrounding the working site, especially when the site is in the residential or school district.

SUMMARY OF THE INVENTION

It is therefore a primary object of the present invention to provide a powder-actuated anchor shooter with which the anchor may be automatically, conveniently, continuously, and precisely shot to the desired spots. Meanwhile, the noise from explosion of powder can be muffled.

The powder-actuated anchor shooter according to the present invention mainly consists of a shooting mechanism and a thrusting mechanism. The shooting mechanism provides convenient and precise aiming, and the thrusting mechanism provides buffer shooting, these together with shell-free powder chain and powder feeding mechanism enable the anchor shooter to steadily, efficiently, and powerfully implant anchors into a structural material at high precision.

DETAILED DESCRIPTION OF THE PREFERRED EMBODIMENT

Figure 1:
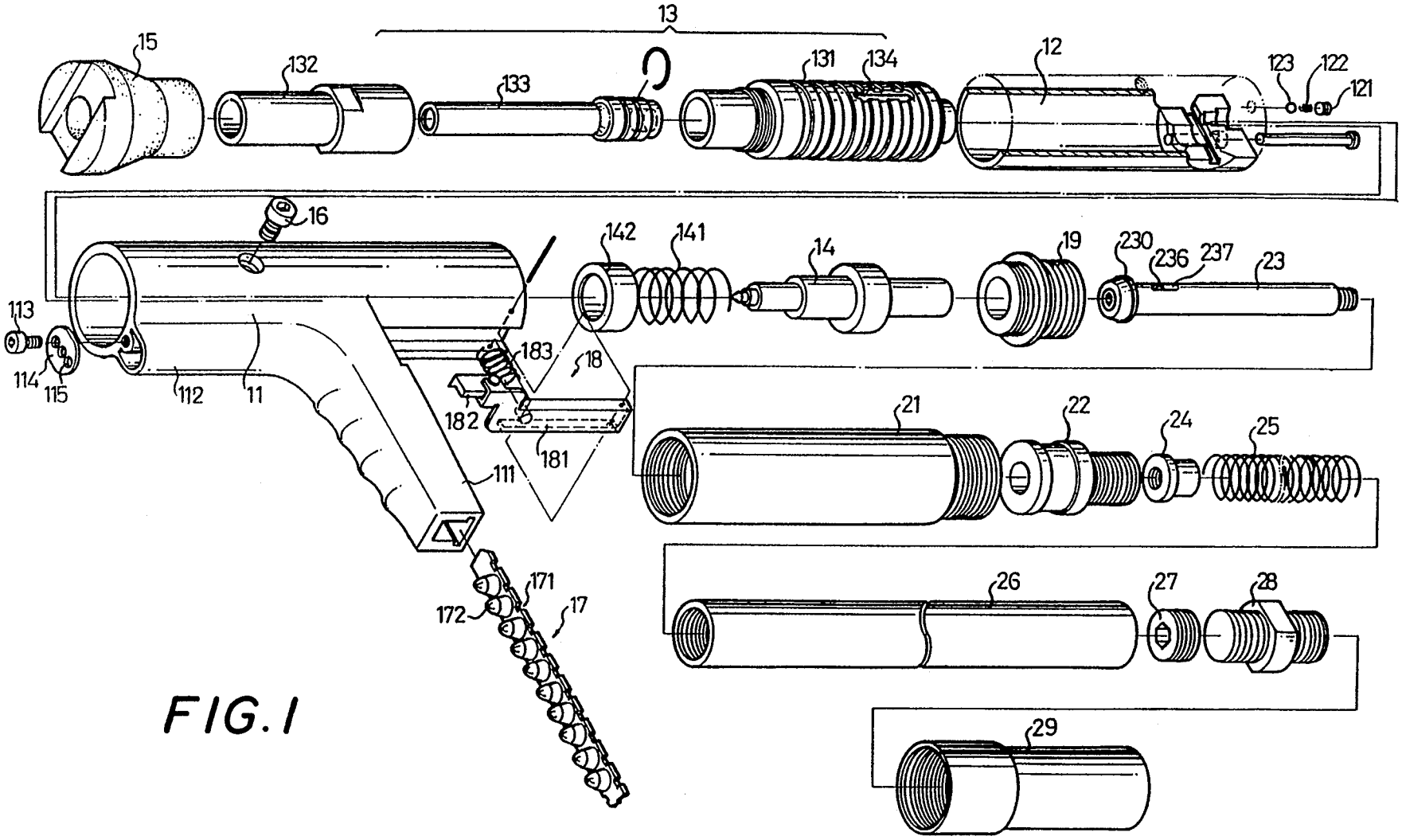
FIG. 1 is a disassembled perspective of the present invention.

Please refer to FIG. 1. The present invention mainly consists of a shooting mechanism 1 and a thrusting mechanism 2. The shooting mechanism 1 includes a main body 11, an inner tube 12 disposed in a front portion of the main body 11, a shooting assembly 13, a dust guard 15, and a hammer 14 disposed in a rear portion of the main body 11.

The shooting assembly 13 further includes a hollow body member 131, a head member 132, and a piston rod 133. The piston rod 133 is disposed in the coupled hollow body member 131 and head member 132 and can reciprocate therein.

The inner tube 12 is received in the front hollow portion of the main body 11 and the shooting assembly 13 is then received in the inner tube 12. A screw 16 passes through a hole formed on the main body 11 and extends into the inner tube 12 before being retained in an elongated slot 134 formed on the hollow body member 131, such that the shooting assembly 13 may reciprocatingly displace inside the inner tube 12 within a predetermined range. A coil spring 122 and a steel ball 123 received in front of the coil spring 122 are fixed to each side of a rear seat of the inner tube 12 by a screw 121, such that the steel balls 123 protrude into an inner side of the rear seat of the inner tube 12 to springily clamp between them a powder chain 17 by engaging with one of the continuous recess pairs 171 formed at two sides of the powder chain 17. The powder chain 17 extends into the main body 11 from a bottom opening of a front grip 111 of the main body 11 and is moved upward in one direction by means of a springy trigger 18. The powder chain 17 consists of a series of powder packs 172 each of which locates between two adjoining recess pairs 171 and is thereby positioned in place by the steel balls 123. The springy trigger 18 consists of a lever 181 inclinedly extending between the front grip 111 and the rear portion of the main body 11 and an inclined plate 182 connected to a front end of the lever 181. A spring 183 connects with the lever 181 at a point near its central portion to give the lever 181 some extent of spring force, so that the trigger 18 may be springily moved to displace the powder chain 17 in one direction.

Figure 2:
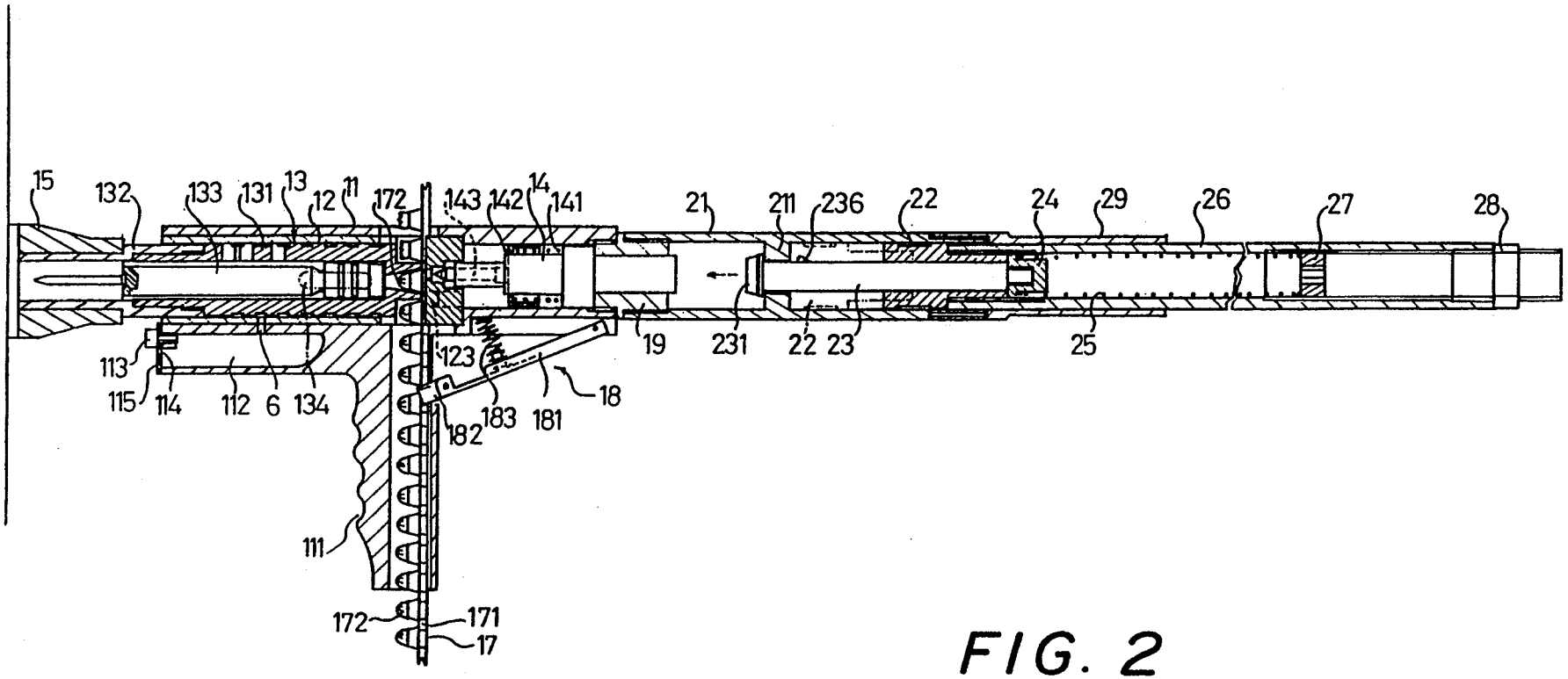
FIG. 2 is a-sectional view of the present invention showing the operation thereof.
Figure 3:
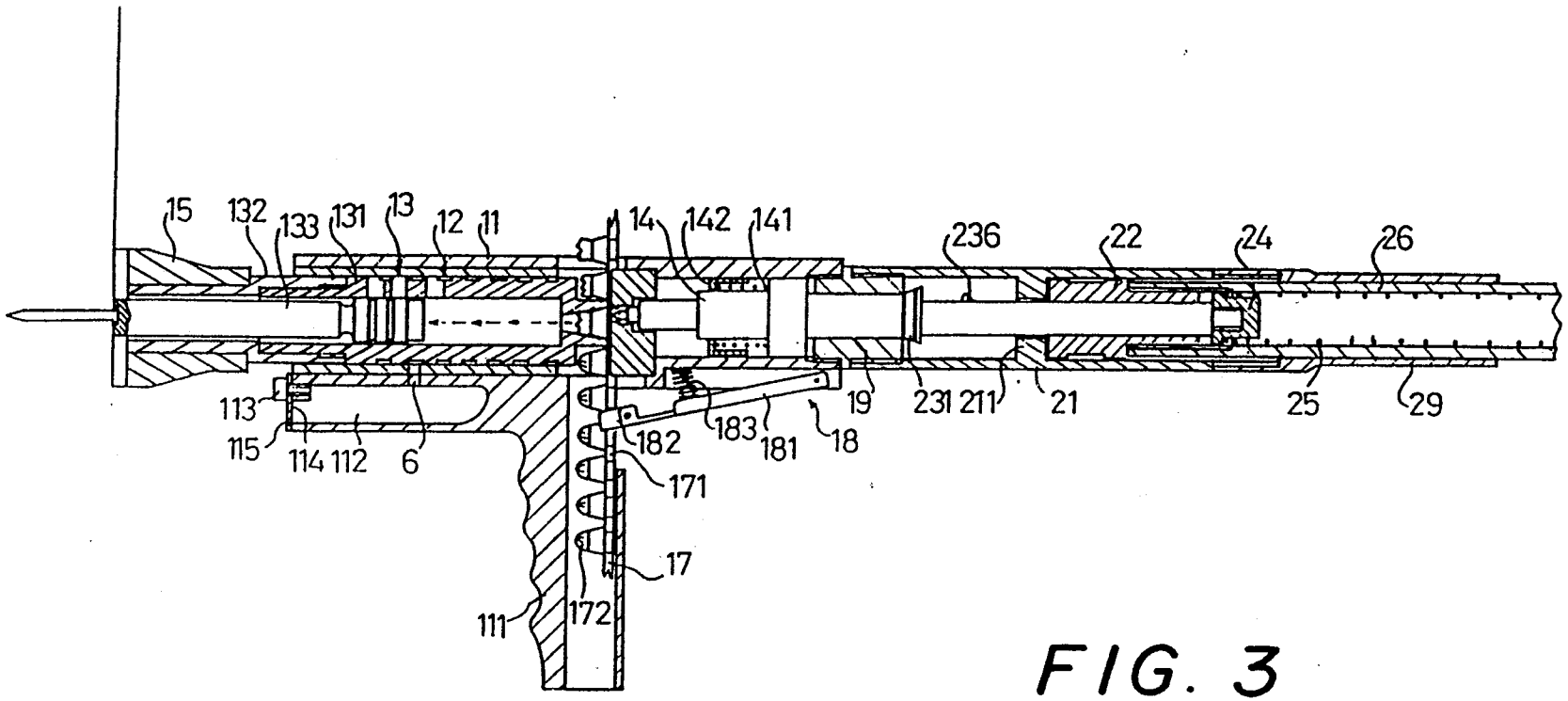
FIG. 3 is still a sectional view of the present invention showing the operation thereof.

A spring 141 and a hollow housing 142 are put over the hammer 14 disposed in the rear portion of the main body 11. A first connection piece 19 behind the hammer 14 fixes the hammer 14, spring 141 and hollow housing 142 in the main body 11 such that a pointed head of the hammer 14 reaches into the rear seat of the inner tube 12, as shown in FIGS. 2 and 3, pointing to a percussion position of the positioned powder pack 172. A restoring bar 143 is disposed between the hollow housing 142 of the hammer 14 and the shooting assembly 13 to maintain the relative position of the two. That is, when the shooting assembly 13 restores to its original position, the bar 143 shall push the hammer 14 backward and stop the same in place lest the feeding of powder chain 17 should be hindered.

A substantially closed muffler chamber 112 is provided at a lower front of the main body 11 and is communicable with the main body 11 via a through hole 6 provided at the top of the muffler chamber 112, as shown in FIGS. 2 and 3. A cover 114 is fixed to a front opening of the muffler chamber 112 by means of a screw 113 and has a through hole 115 formed at a predetermined position thereon. When one of the powder packs 172 is set off to explode in the main body 11, the high-pressure gas so produced may be guided into the muffler chamber 112 via the through hole 6 and then be slowly discharged from the through hole 115. With the hollow muffler chamber 112, the sound wave of sonic boom produced in the main body 11 shall be enclosed and reflect within the substantially closed muffler chamber 112 without leaking out there. The noise brought along with the explosion of powder pack 172 is thereby largely reduced.

The thrusting mechanism 2 of the present invention consists of a coupling 21, a sliding block 22, a centre rod 23, a connection member 24, a spring 25, a hollow push member 26, an inner hexagon screw 27, a second connection piece 28, and a sleeve 29. Please refer to FIGS. 1, 2 and 3. The coupling 21 is screwed to a rear end of the first connection piece 19 of the shooting mechanism 1 and has a middle partition 211 therein. All the centre rod 23, sliding block 22, and connection member 24 are received in the coupling 21.

The centre rod 23 is a slender rod having a front head 231 with larger outer diameter and a threaded rear end to engage with the connection member 24. The front head 231 of the centre rod 23 is retained to one front side of the middle partition 211 of the coupling 21 and a rear portion of the centre rod 23 is received in the sliding block 22 and the connection member 24 behind the sliding block 22.

Figure 5:
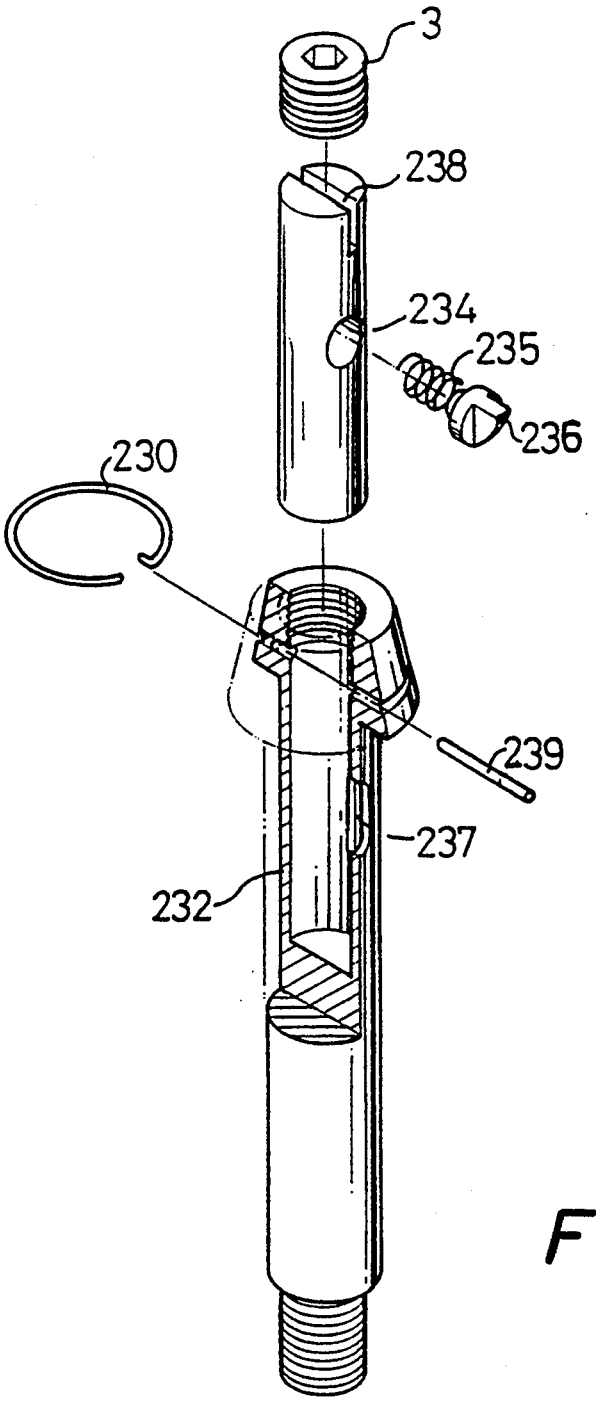
FIG. 5 illustrates the centre rod of the thrusting mechanism of the present invention.

Please refer to FIG. 5. The centre rod 23 is a solid rod but has a central hole 232 formed at its front portion for receiving an inner rod 233 therein. The inner rod 233 has a side hole 234 at a middle portion thereof for receiving a spring 235 and a spring key 236 therein. The spring key 236 has a substantially triangular top piece having one single backward and downward inclined surface and is springily retractable in the side hole 234. An elongated through hole 237 is formed on the wall of the central hole 232 corresponding to the spring key 236 so as to allow the spring key 236 to project out of the centre rod 23 and to limit the displacement of the spring key 236. A slit 238 is provided on top of the inner rod 233, and a pin 239 transversely passes through the front head 231 of the centre rod 23 and the slit 238 to retain the inner rod 233 in the central hole 232. Then, a C-ring 230 is engaged with a preformed annular groove on the front head 231 to fix the pin 239 in place. Finally, an inner hexagon screw 3 is screwed to the top of the central hole 232 over the inner rod 233 and thereby retains the inner rod 233 in the centre rod 23.

Due to the backward and downward inclined surface and the retractility of the spring key 236, as well as the front head with larger outer diameter, the centre rod 23, when being inserted in the coupling 21 with the rear end thereof passing through the middle partition 211 and extending into the rear portion of the coupling 21, will be retained inside the coupling 21. After extending through the coupling 21, the threaded rear end of the centre rod 23 passes through the sliding block 22 and engages with the connection member 24. The spring 25 is put over a rear end of the connection member-24 and the push member 26 is further put over the spring 25 with its front end screwed to the rear end of the sliding block 22 so that the push member 26 may push the sliding block 22 to move. The inner hexagon screw 27 is internally screwed to the rear end of the push member 26 to abut against the rear end of the spring 25. The adjustment of the position of screw 27 in the push member 26 may adjust the spring force of the spring 25 lest the spring 25 should fatigue and deform after a long period of use. The sleeve 29 has a front end with internal threads for the sleeve 29 to screw to the externally threaded rear end of the coupling 21 and receive a part of the push member 26 and thereby prevents the push member 26 from loosely swaying. The second connection piece 28 is screwed at one end to the rear end of the push member 26 and at the other (rear) end to a handle 4 or other member, depending on the actual need, as shown in FIG. 6.

Please refer to FIG. 2 which shows a powder-actuated anchor shooter of the present invention in a state of ready for use. When the push member 26 is gradually pushed forward, the sliding block 22 is caused to move forward and the spring 25 is compressed to store larger spring force. When the sliding block 22 is moved to contact the spring key 236 of the centre rod 23, the spring key 236 is springily depressed into the centre rod 23 and the centre rod 23 is no longer retained behind the middle partition 211 of the coupling 21 by the spring key 236. At this point, the compressed spring 25 with largely stored energy of movement shall instantaneously thrust the centre rod 23 forward, causing the front head 231 of the centre rod 23 to strongly impact upon the hammer 14, which in turn contacts the powder pack 172 and causes the same to explode. The pressure produced by the explosion of powder pack 172 is immediately sent into the shooting assembly 13 to powerfully thrust the piston rod 133 which in turn thrusts a anchor 5 loaded in front of the head member 132 and the anchor 5 is thereby shot and implanted into the wall or the target, as shown in FIG. 3.

Figure 4:
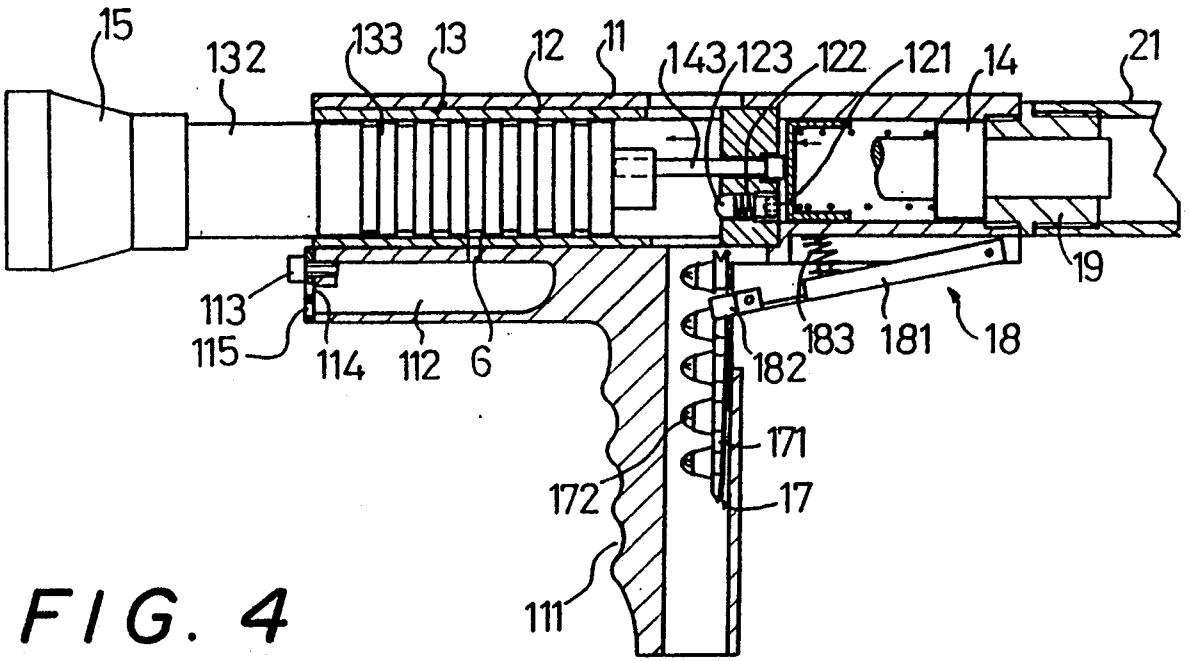
FIG. 4 is a partial sectional view of the present invention showing the restoring of the shooting mechanism thereof after an anchor is shot.

Please further refer to FIG. 4. When the powder pack 172 explodes, the shooting assembly 13 is pushed forward for a certain distance which is limited by the screw 16. When a second anchor 5 is loaded, the shooting assembly 13 is pressed to a position ready for the next thrust. When the push member 26 is pushed, the shooting assembly 13 forms a buffer distance and thrusts backward, thereby, the restoring bar 143 backward pushes the hammer 14 to the original position for the next impact.

Figure 6:
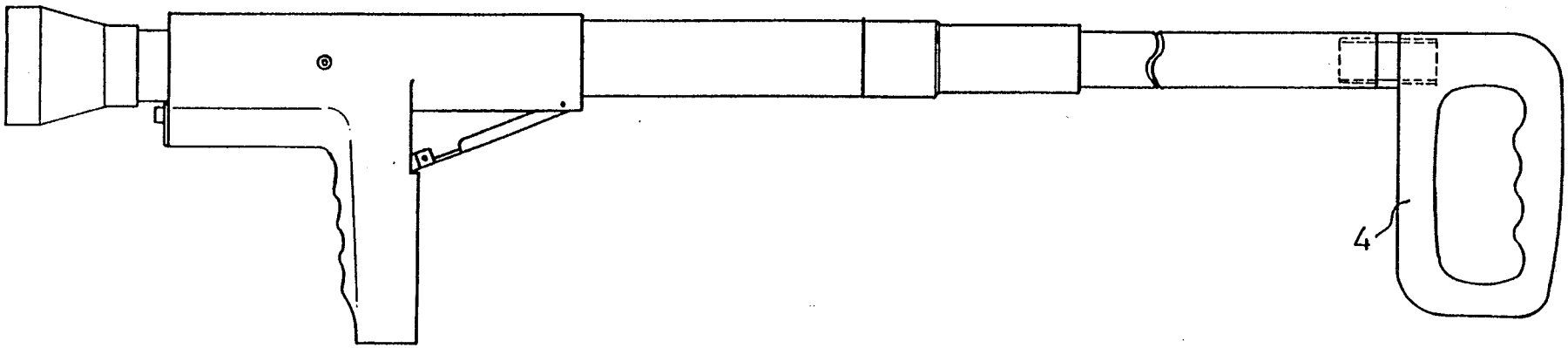
FIG. 6 illustrates an embodiment of the present invention.
Figure 7:
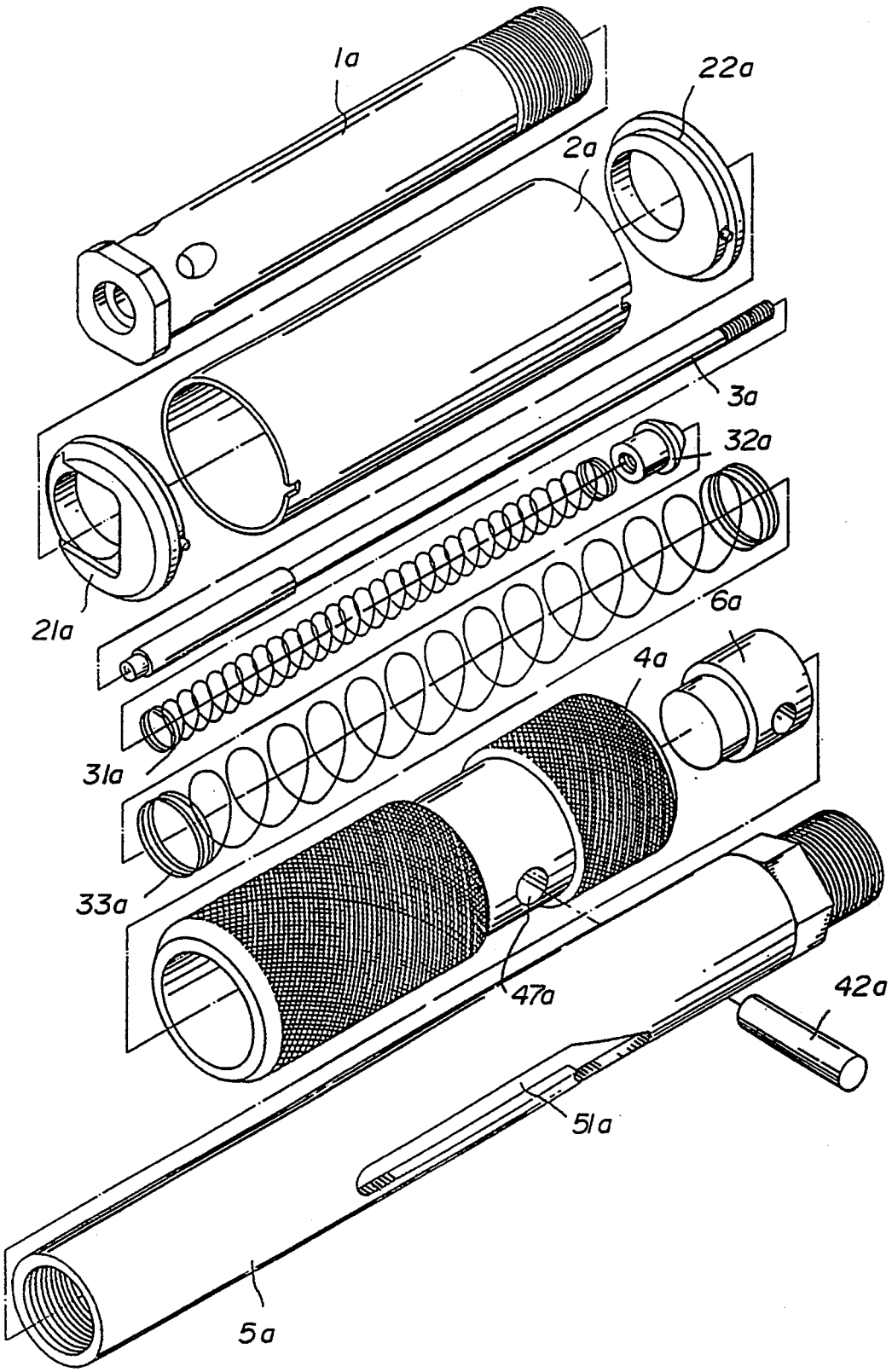
FIG. 7 Prior Art
FIG. 7 is a disassembled perspective of a conventional powder-actuated fastening tool.
Figure 8:
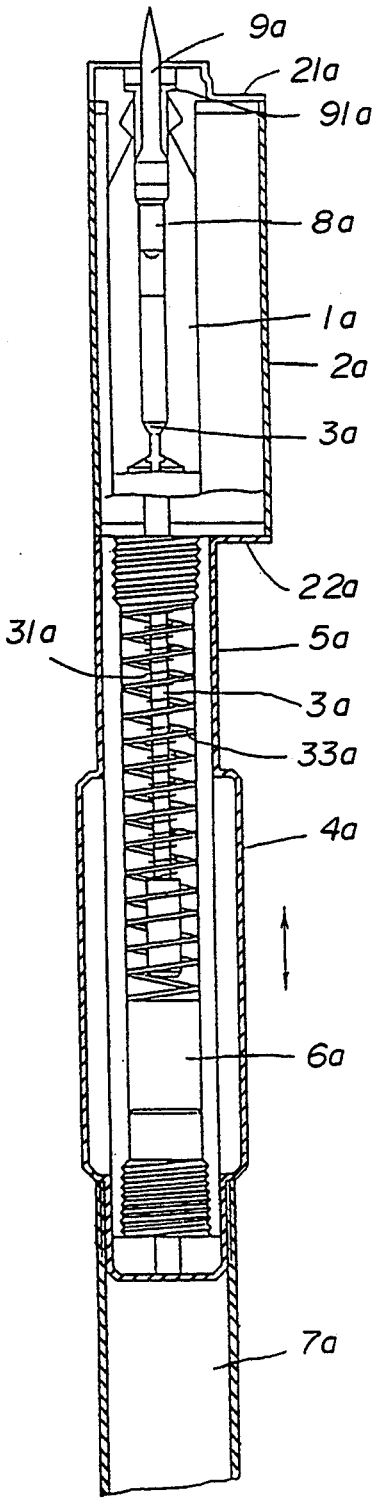
FIG. 8 Prior Art
FIG. 8 is a sectional view of the conventional fastening tool shown by FIG. 7.

FIG. 6 shows an embodiment of the present invention. A handle or grip 4 may be screwed to the rear end of the second connention piece 28. When the grip 4 is used together with the front grip 111 of the main body 11, the anchor shooter of the present invention can be conveniently held as a rifle to firmly shoot the anchor 5 at a short distance or at a special angle.

What is claimed is:

1. A semi-automatic anchor shooter comprising a shooting mechanism and a thrusting mechanism;

said shooting mechanism comprising a main body, an inner tube disposed in a front portion of said main body, a shooting assembly, a dust guard, and a hammer disposed at a rear portion of said main body;

said shooting assembly including a hollow body member, a head member coupled to a front portion of said body member, and a piston rod disposed in said coupled body member and head member to reciprocatingly move therein;

said inner tube being received in said front portion of said main body and said shooting assembly being received in said inner tube and fixed thereto by means of a screw which passes through a hole formed on said main body and extends into said inner tube before being retained in an elongated slot formed on said hollow body member, such that said shooting assembly may reciprocatingly displace inside said inner tube within a predetermined range;

said inner tube being provided at each side of a rear seat thereof a coil spring and a steel ball received in front of said coil spring both of which are fixed to said inner tube by a screw, such that said steel balls protrude into an inner side of said rear seat of said inner tube to springily clamp between them a powder chain by engaging with one of a plurality of continuous recess pairs at two sides of said powder chain, said powder chain extending into said main body from a bottom opening of a front grip of the main body and being moved upward in one direction by means of a springy trigger; said powder chain consisting of a series of powder packs each of which locates between two adjoining recess pairs and is thereby positioned in place by said steel balls; said springy trigger consisting of a lever inclinedly extending between said front grip and said rear portion of said main body and an inclined plate connected to a front end of said lever, said lever connecting at a point near its central portion a first spring to give said lever some extent of spring force so that said trigger may be springily moved to shift the powder chain in one direction;

said hammer being disposed in said rear portion of said main body and having a second spring and a hollow housing put over a front section thereof; said second spring and said hollow housing being fixed in said main body by means of a first connection piece behind said hammer, such that a pointed head of said hammer reaches into said rear seat of said inner tube, pointing to a percussion position of said positioned powder pack; said hammer and said shooting assembly being maintained at a pretermined relative position by means of a restoring bar disposed between said hollow housing of said hammer and said shooting assembly, such that when said shooting assembly restores to it original position, said restoring bar pushes said hammer backward and keep the same in place lest the feeding of said powder chain should be hindered;

said shooting mechanism comprising a coupling, a sliding block, a centre rod, a connection member, a third spring, a hollow push member, an inner hexagon screw, a second connection piece, and a sleeve; said coupling being screwed to a rear end of said first connection piece of said shooting mechanism and having a middle partition therein; said centre rod, said sliding block, and said connection member all being received in said coupling; said centre rod having a front head with larger outer diameter and a threaded rear end to engage with said connection member, said front head of said centre rod being retained at a front side of said middle partition of said coupling and a rear portion of said centre rod being received in said sliding block and said connection member behind said sliding block; and said centre rod being provided near a front end thereof a spring key which has a backward and downward inclined top surface;

said third spring being put over a rear end of said connection member and said push member being further put over said third spring with a front end thereof screwed to said rear end of said sliding block so that said push member may push said sliding block to move; said inner hexagon screw being internally screwed to a rear end of said push member to abut against a rear end of said third spring such that an adjustment of the position of said inner hexagon screw in said push member may adjust the spring force of said third spring, lest said third spring should fatigue and deform after a long period of use; said sleeve having a front end with internal threads for said sleeve to screw to an externally threaded rear end of said coupling and receiving a part of said push member therein, and thereby preventing said push member from loosely swaying; and said second connection piece being screwed at one end to said rear end of said push member.

2. A semi-automatic anchor shooter as claimed in claim 1, wherein said main body is provided at a lower front thereof a substantially closed muffler chamber and is communicable with said muffler chamber via a first through hole provided at a top of said muffler chamber; said muffler chamber having a front opening being closed by a cover fixed thereto by means of a screw, and said cover having a second through hole formed at a predetermined position thereon.

3. A semi-automatic anchor shooter as claimed in claim 1, wherein said centre rod is provided at a front portion thereof a central hole for receiving an inner rod therein, said inner rod having a side hole formed at a middle portion thereof for receiving a fourth spring and said spring key therein, such that said spring key is springily retractable in said side hole; said centre rod having a long slot formed on the wall of said central hole corresponding to said spring key so as to allow said spring key to project out of said centre rod and to limit the displacement of said spring key; said inner rod having a slit formed on a top thereof for a pin to transversely pass through said front head of said centre rod and thereby holding said inner rod in said inner hole, said pin then being located in a preformed annular groove on the front head by a C-ring, and said inner rod being securely restricted in said centre rod by screwing an inner hexagon screw into a top of said front head over said inner rod.

* * * * *